US012566001B2

(12) United States Patent
Holtdirk

(10) Patent No.: US 12,566,001 B2
(45) Date of Patent: Mar. 3, 2026

(54) COOKING APPLIANCE MUFFLE FOR A COOKING APPLIANCE, COOKING APPLIANCE AND METHOD FOR OPERATING A COOKING APPLIANCE

(71) Applicant: Miele & Cie. KG, Guetersloh (DE)

(72) Inventor: Hans-Gerd Holtdirk, Lippstadt (DE)

(73) Assignee: MIELE & CIE. KG, Guetersloh (DE)

( * ) Notice: Subject to any disclaimer, the term of this patent is extended or adjusted under 35 U.S.C. 154(b) by 388 days.

(21) Appl. No.: 18/336,025

(22) Filed: Jun. 16, 2023

(65) Prior Publication Data

US 2023/0408110 A1 Dec. 21, 2023

(30) Foreign Application Priority Data

Jun. 21, 2022 (DE) ..... 10 2022 115 343.6

(51) Int. Cl.
*F24C 15/36* (2006.01)

(52) U.S. Cl.
CPC ..... *F24C 15/36* (2013.01)

(58) Field of Classification Search
CPC ..... F24C 15/36
USPC ..... 126/1 R
See application file for complete search history.

(56) References Cited

U.S. PATENT DOCUMENTS

| | | | | |
|---|---|---|---|---|
| 2,801,768 | A * | 8/1957 | Immel | H01H 9/043 220/88.2 |
| 4,940,040 | A * | 7/1990 | Randall | A21B 1/48 126/41 R |
| 5,493,119 | A * | 2/1996 | Torngren | G01N 21/532 219/707 |
| 2004/0218315 | A1* | 11/2004 | Mizuno | H01T 23/00 361/1 |
| 2015/0020692 | A1 | 1/2015 | Frank et al. | |
| 2022/0167646 | A1* | 6/2022 | Herlitzius | A47J 27/04 |

FOREIGN PATENT DOCUMENTS

| | | | |
|---|---|---|---|
| DE | 1025122 | B | 2/1958 |
| DE | 102011105597 | A1 | 12/2012 |
| DE | 102012210749 | A1 | 1/2014 |
| DE | 102012222143 | A1 | 6/2014 |
| DE | 102013214319 | A1 | 1/2015 |

* cited by examiner

*Primary Examiner* — Avinash A Savani
(74) *Attorney, Agent, or Firm* — Leydig, Voit & Mayer, Ltd.

(57) ABSTRACT

A cooking appliance muffle for a cooking appliance includes: a cooking chamber with a cooking chamber opening tightly closeable by a door of the cooking appliance, at least one cooking chamber wall bounding the cooking chamber. The cooking appliance muffle is explosion-proof. The cooking appliance muffle has, on a side of one of the at least one cooking chamber wall facing the cooking chamber, an anti-explosion device that prevents a formation of an explosive gas mixture in any operating state of the cooking appliance muffle.

19 Claims, 2 Drawing Sheets

COOKING APPLIANCE MUFFLE FOR A COOKING APPLIANCE, COOKING APPLIANCE AND METHOD FOR OPERATING A COOKING APPLIANCE

CROSS-REFERENCE TO PRIOR APPLICATION

Priority is claimed to German Patent Application No. DE 10 2022 115 343.6, filed on Jun. 21, 2022, the entire disclosure of which is hereby incorporated by reference herein.

FIELD

The invention relates to a cooking appliance muffle for a cooking appliance, a cooking appliance and a method for operating a cooking appliance.

BACKGROUND

Cooking appliance muffles for cooking appliances, cooking appliances and methods for operating cooking appliances are known from the prior art in a variety of embodiments. Known cooking appliance muffles comprise, for example, a cooking chamber with a cooking chamber opening that can be tightly closed by means of a door of the cooking appliance and at least one cooking chamber wall for bounding the cooking chamber. In certain operating states of cooking appliances with cooking appliance muffles, there is a risk of explosion of explosive gas mixtures that may form in the cooking chamber. For certain markets, for example the North American market, an explosion test of cooking appliance muffles and cooking appliances equipped with them is therefore mandatory for approval.

SUMMARY

In an embodiment, the present invention provides a cooking appliance muffle for a cooking appliance, comprising: a cooking chamber with a cooking chamber opening tightly closeable by a door of the cooking appliance, at least one cooking chamber wall bounding the cooking chamber, wherein the cooking appliance muffle is configured to be explosion-proof, and wherein the cooking appliance muffle has, on a side of one of the at least one cooking chamber wall facing the cooking chamber, an anti-explosion device configured such that a formation of an explosive gas mixture is prevented in any operating state of the cooking appliance muffle.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
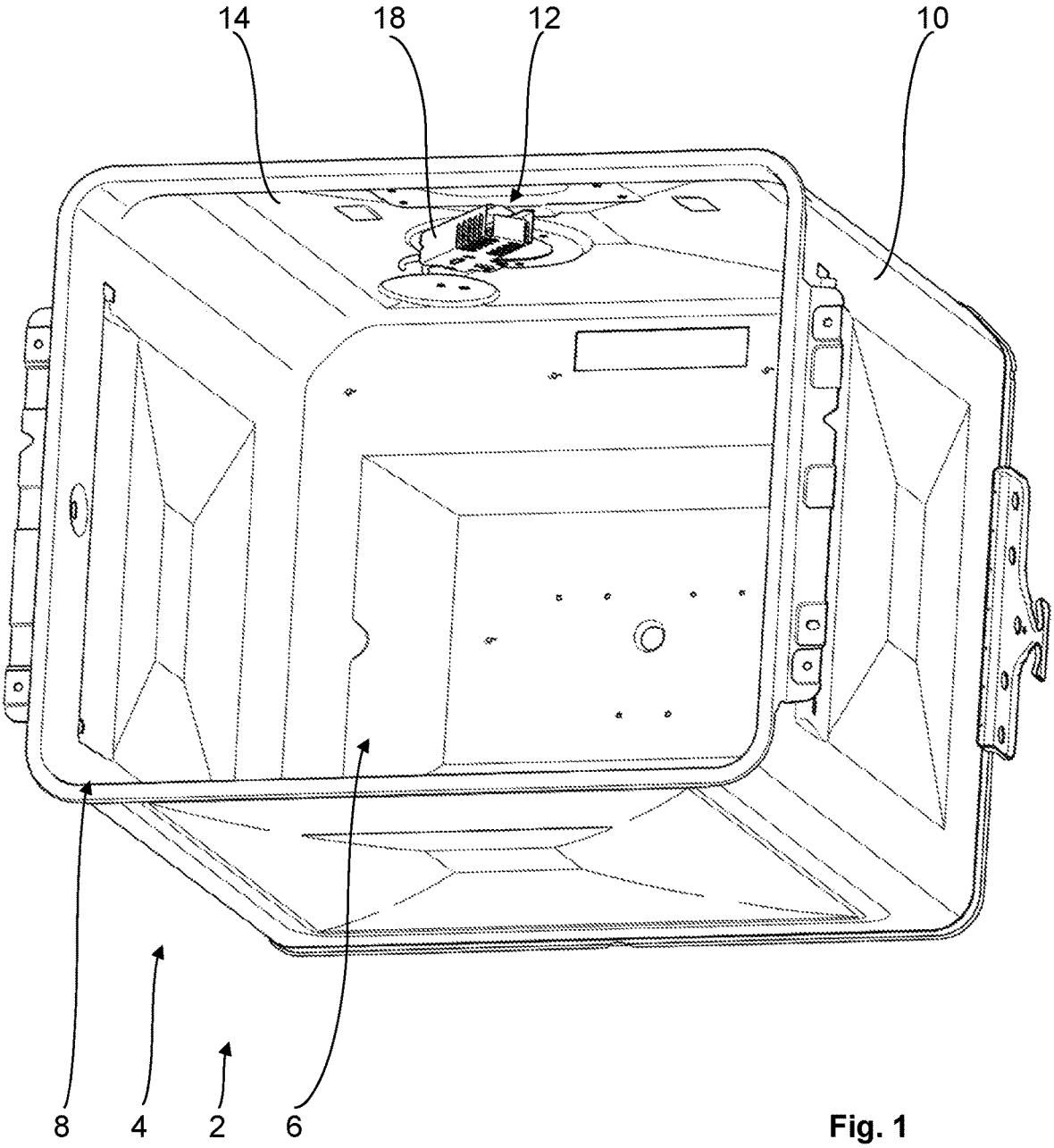
FIG. 1 shows an exemplary embodiment of the cooking appliance according to the invention with the cooking appliance muffle according to the invention in a partial, perspective view, looking at the anti-explosion device

In an embodiment, the present invention improves a cooking appliance muffle for a cooking appliance, a cooking appliance and a method for operating a cooking appliance.

In an embodiment, the present invention provides a cooking appliance muffle for a cooking appliance having the features described herein, which is wherein the cooking appliance muffle is designed and configured to be explosion-proof, wherein the cooking appliance muffle has, on a side of one of the at least one cooking chamber wall facing the cooking chamber, an anti-explosion device that is designed and configured in such a way that a formation of an explosive gas mixture is prevented in any operating state of the cooking appliance muffle. Further, this problem is solved by a cooking appliance as described herein and by a method as described herein.

In particular, an advantage achievable by the invention is that a cooking appliance muffle for a cooking appliance, a cooking appliance and a method for operating a cooking appliance are improved. Due to the design of the cooking appliance muffle for a cooking appliance, the cooking appliance and the method for operating a cooking appliance according to the invention, the risk of an explosion in the cooking chamber of the cooking appliance muffle and the cooking appliance equipped with it is counteracted in a particularly simple and robust manner. Accordingly, the cooking appliance muffle and the cooking appliance equipped with it can be manufactured at a substantially lower cost, since explosion resistance, for example, does not have to be taken into account in the design and manufacture of the cooking appliance muffle according to the invention and the cooking appliance equipped with it. By means of the invention, damage or pre-damage to the cooking appliance muffle and/or a remainder of the cooking appliance by an explosion is effectively prevented.

In principle, the cooking appliance muffle for a cooking appliance according to the invention and the cooking appliance according to the invention equipped with it are freely selectable in terms of type, mode of operation, material and dimensioning within wide suitable limits. For example, the cooking appliance according to the invention can be designed as an oven, a steam cooking appliance, a microwave device or as a combination device with a plurality of heating modes that are different from one another. Furthermore, the cooking appliance according to the invention can be designed as a household cooking appliance or as a commercial cooking appliance, i.e. a cooking appliance for professional use. In addition, the cooking appliance according to the invention can conceivably be designed as a so-called pyrolysis appliance, i.e. an appliance with a self-cleaning function. The design of the cooking appliance muffle for a cooking appliance according to the invention is correspondingly diverse. For example, the design and arrangement of the anti-explosion device can be freely selected within wide suitable limits.

An advantageous development, or embodiment, of the cooking appliance muffle for a cooking appliance according to the invention provides that the anti-explosion device is arranged on a cooking chamber ceiling of the cooking chamber. In this way, the anti-explosion device is arranged in a particularly advantageous manner on a remainder of the cooking appliance muffle and relative to the cooking chamber. The anti-explosion device is expediently positioned centrally on the cooking chamber ceiling.

A further advantageous development of the cooking appliance muffle according to the invention provides that the anti-explosion device is designed in such a way that a proportion of a combustible component in the cooking chamber remains below a predetermined limit value for the combustible component in any operating state of the cooking appliance muffle. This effectively prevents an explosion in the cooking chamber, since, by means of the anti-explosion device according to the present development, an essential component for the formation of an explosive gas mixture is not available in sufficient quantity for an explosion.

An advantageous development of the aforementioned embodiment of the cooking appliance muffle according to the invention provides that the anti-explosion device has an ignition source that can be switched on and off by means of a controller of the cooking appliance, wherein the ignition source is designed in such a way that, in a switched-on state of the ignition source, a temperature of the ignition source is equal to or greater than an ignition temperature of the theoretically possible explosive gas mixture, preferably that the temperature of the ignition source is greater than or equal to 1000° C. In this way, it is possible to activate the anti-explosion device in the desired manner only at certain operating states of the cooking appliance and thus of the cooking appliance muffle, in which the formation of an explosive gas mixture in the cooking chamber is possible in principle. In other operating states of the cooking appliance and thus of the cooking appliance muffle, in which this is not possible at all, the ignition source can remain switched off. By means of the preferred embodiment of such development, a temperature at which sufficient combustion of the combustible component occurs in any case is achievable by means of the ignition source. The ignition source switched on in the aforementioned manner can be switched on permanently or intermittently, whereas the ignition source switched off remains completely switched off. The phrase "theoretically possible explosive gas mixture" is intended to describe the case prevented by means of the invention, in which an explosive gas mixture can actually form in the cooking chamber.

An advantageous development of the latter development of the cooking appliance muffle according to the invention provides that the ignition source is designed as a glow igniter or a spark plug. Glow igniters and spark plugs are available on the market in a variety of designs, very robust and durable.

Another advantageous development of the cooking appliance muffle according to the invention provides that the anti-explosion device comprises an enclosure, wherein the enclosure surrounds a remainder of the anti-explosion device in such a way that such remainder of the anti-explosion device is protected from manual damage, preferably, that the function of the anti-explosion device can be fulfilled substantially equivalently compared to such anti-explosion device without an enclosure, particularly preferably, that the remainder of the anti-explosion device comprises an ignition source. This ensures proper functioning of the anti-explosion device even in the long term and even if a user of the cooking appliance cleans the cooking chamber in an improper manner, for example. This is particularly true for the preferred and especially for the particularly preferred embodiment of such development.

Analogous to the cooking appliance muffle for a cooking appliance according to the invention and the cooking appliance according to the invention, the method according to the invention can also be freely selected within wide suitable limits.

Insofar as the cooking appliance according to the invention is designed as a pyrolysis cooking appliance, an advantageous development of the method according to the invention provides that the anti-explosion device is activated as a function of the presence of a pyrolysis operation of the cooking appliance. In this way, the activation of the anti-explosion device can be limited to the pyrolysis operation, for example, provided that the formation of an explosive gas mixture in the cooking chamber is not possible in the other operating states of the cooking appliance according to the invention and the cooking appliance muffle.

Accordingly, an advantageous development of the aforementioned development of the method according to the invention provides that the ignition source of the anti-explosion device is automatically switched on as a function of the presence of the pyrolysis operation of the cooking appliance and is automatically switched off during operation of the cooking appliance outside the pyrolysis operation, preferably that the ignition source in the switched-on state of the ignition source after a warm-up time permanently has a temperature equal to or greater than an ignition temperature of the theoretically possible explosive gas mixture. The ignition source switched on in the aforementioned manner can be switched on permanently or intermittently, as already explained above, whereas the switched-off ignition source remains completely switched off.

Figure 2:
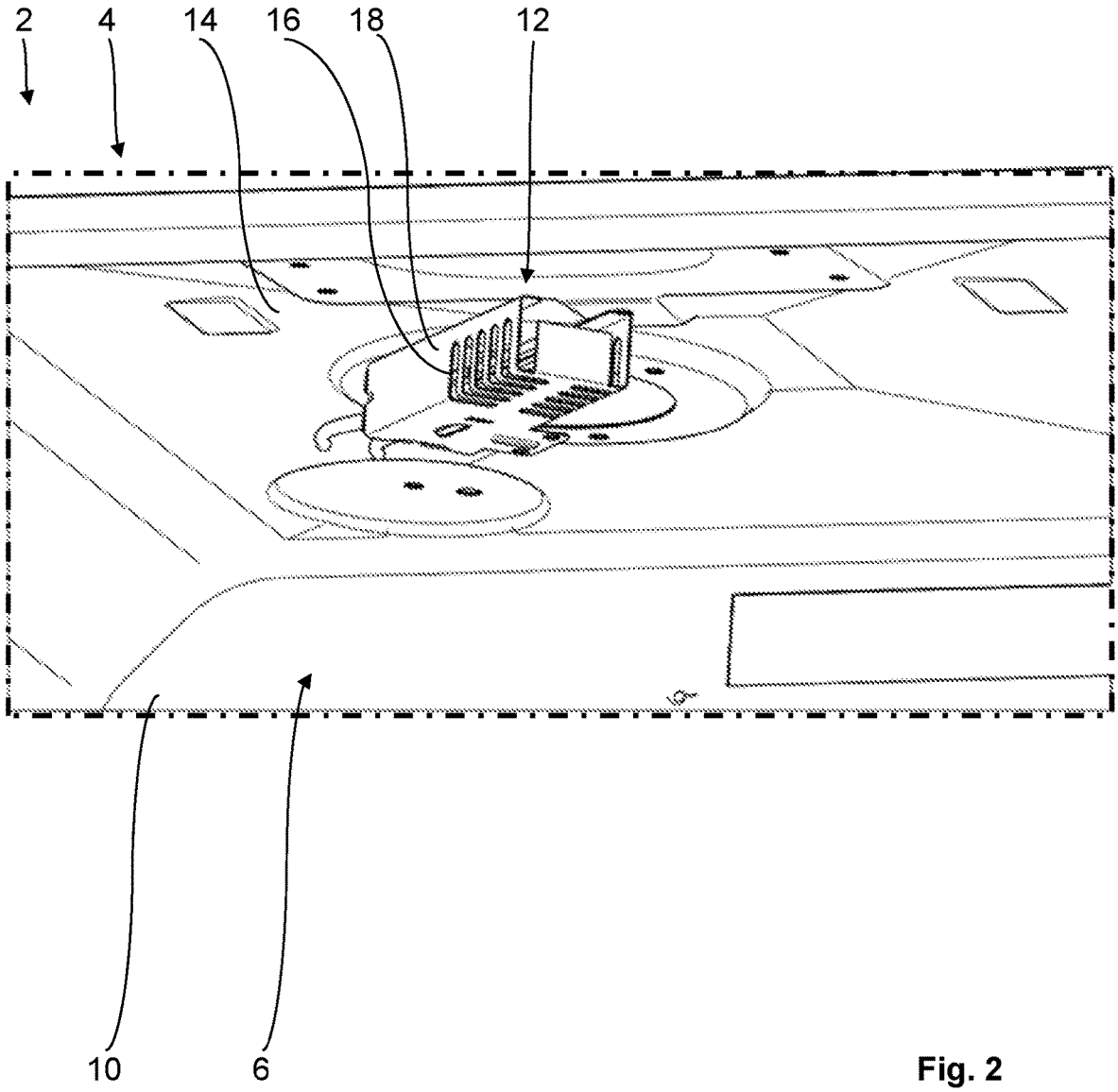
FIG. 2 shows an exemplary embodiment in an enlarged, detailed perspective view in the region of the anti-explosion device.

FIGS. 1 and 2 show a purely exemplary embodiment of the cooking appliance according to the invention with the cooking appliance muffle according to the invention for carrying out the method according to the invention.

The cooking appliance 2, which is designed as a household oven with a pyrolysis function, comprises a controller and a cooking appliance muffle 4.

The cooking appliance muffle 4 has a cooking chamber 6 with a cooking chamber opening 8 that can be tightly closed by means of a door of the cooking appliance 2, and at least one cooking chamber wall 10 for bounding the cooking chamber 6.

According to the invention, the cooking appliance muffle 4 is designed and configured to be explosion-proof, wherein the cooking appliance muffle 4 has, on a side of one of the at least one cooking chamber wall 10 facing the cooking chamber 6, an anti-explosion device 12 that is designed and configured in such a way that a formation of an explosive gas mixture is prevented in any operating state of the cooking appliance muffle 4.

As can be seen in particular from FIG. 1, with the present exemplary embodiment, the anti-explosion device 12 is arranged on a cooking chamber wall 10 of the at least one cooking chamber wall 10, which is designed as a cooking chamber ceiling 14 of the cooking chamber 6.

Here, the anti-explosion device 12 is designed in such a way that a proportion of a combustible component in the cooking chamber 6 remains below a predetermined limit value for the combustible component in any operating state of the cooking appliance muffle 4.

The anti-explosion device 12 has an ignition source 16 that can be switched on and off by means of the controller of the cooking appliance 2, wherein the ignition source 16 is designed in such a way that, in a switched-on state of the ignition source 16, a temperature of the ignition source 16 is equal to or greater than an ignition temperature of the theoretically possible explosive gas mixture, wherein the temperature of the ignition source here is greater than or equal to 1000° C. The ignition source 16 is designed, for example, as a glow igniter or a spark plug.

With the present exemplary embodiment, the anti-explosion device 12 further comprises an enclosure 18, wherein the enclosure 18 surrounds a remainder of the anti-explosion device 12 in such a manner that such remainder of the anti-explosion device 12 is protected from manual damage, wherein the function of the anti-explosion device 12 can be fulfilled substantially equivalently compared to such anti-explosion device 12 without an enclosure 18. In particular, the remainder of the anti-explosion device 12 comprises the ignition source 16.

In the following, the mode of operation of the cooking appliance according to the invention with the cooking appliance muffle according to the invention and the method according to the invention for operating a cooking appliance according to the present exemplary embodiment are explained in more detail based on FIGS. 1 and 2.

Initially, the cooking appliance 2 with the cooking appliance muffle 4 is in a non-pyrolysis operating state and the door for closing the cooking chamber opening 8 is in its closed position, such that the cooking chamber opening 8 and thus the cooking chamber 6 are closed.

For the purpose of carrying out self-cleaning of the cooking appliance muffle 4, a pyrolysis function of the cooking appliance 2 designed as a pyrolysis appliance is started in a manner known per se to the skilled person, such that the cooking appliance 2 with the cooking appliance muffle 4 is transferred from the aforementioned non-pyrolysis operating state to its pyrolysis operating state.

To prevent an explosion when carrying out the pyrolysis function, the anti-explosion device 12 is automatically controlled by means of the controller in such a way that a formation of an explosive gas mixture is prevented in the pyrolysis operating state of the cooking appliance muffle 4, wherein by means of the anti-explosion device 12, a proportion of a combustible component in the cooking chamber 4 in the pyrolysis operating state of the cooking appliance muffle 4 remains below a predetermined limit value for the combustible component. In the other operating states of the cooking appliance 2, i.e., in the non-pyrolysis operating states of the cooking appliance 2, there is no risk of an explosion, such that it is not necessary to switch on the anti-explosion device 12 for such non-pyrolysis operating states. Thus, with the present exemplary embodiment, the anti-explosion device 12 is activated as a function of the presence of a pyrolysis operation of the cooking appliance 2.

For this purpose, the ignition source 16 of the anti-explosion device 12 is automatically switched on as a function of the presence of the pyrolysis operation of the cooking appliance 2 and is automatically switched off during operation of the cooking appliance 2 outside the pyrolysis operation, wherein the ignition source 16 in the switched-on state of the ignition source 16 after a warm-up time permanently has a temperature equal to or greater than an ignition temperature of the theoretically possible explosive gas mixture. Any combustible components present in the cooking chamber 6 are safely ignited by means of the high temperature of the ignition source 16, specifically 1000° C., and thus burned to such an extent that the minimum proportion of combustible components in the cooking chamber 6 required for an explosive gas mixture is not reached during the pyrolysis operation. Accordingly, an explosion in the cooking chamber 6 is also not possible.

Due to the design of the cooking appliance muffle 4, the cooking appliance 2 and the method for operating the cooking appliance 2 according to the invention, the risk of an explosion in the cooking chamber 6 of the cooking appliance muffle 4 and the cooking appliance 2 equipped with it is counteracted in a particularly simple and robust manner. Accordingly, the cooking appliance muffle 4 and the cooking appliance 2 equipped with it can be manufactured at a substantially lower cost, since explosion resistance, for example, does not have to be taken into account in the design and manufacture of the cooking appliance muffle 4 and the cooking appliance 2 equipped with it. By means of the invention, damage or preliminary damage to the cooking appliance muffle 4 and/or a remainder of the cooking appliance 2 by an explosion is effectively prevented.

The invention is not limited to the present exemplary embodiment. See, for example, the explanations in this regard in the introduction to the description.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cooking appliance muffle for a cooking appliance, comprising:

a cooking chamber with a cooking chamber opening tightly closeable by a door of the cooking appliance, at least one cooking chamber wall bounding the cooking chamber, wherein the cooking appliance muffle is configured to be explosion-proof, wherein the cooking appliance muffle has, on a side of one of the at least one cooking chamber wall facing the cooking chamber, an anti-explosion device configured such that a formation of an explosive gas mixture is prevented in any operating state of the cooking appliance muffle, wherein the anti-explosion device is configured such that a proportion of a combustible component in the cooking chamber remains below a predetermined limit value for the combustible component in any operating state of the cooking appliance muffle, wherein the anti-explosion device has an ignition source that is switchable on and off by a controller of the cooking appliance, and wherein the ignition source is configured such that, in a switched-on state of the ignition source, a temperature of the ignition source is equal to or greater than an ignition temperature of a theoretically possible explosive gas mixture.

2. The cooking appliance muffle of claim 1, wherein the anti-explosion device is arranged on a cooking chamber ceiling of the cooking chamber.

3. The cooking appliance muffle of claim 1, wherein the ignition source comprises a glow igniter or a spark plug.

4. The cooking appliance muffle of claim 1, wherein the anti-explosion device comprises an enclosure, wherein the enclosure surrounds a remainder of the anti-explosion device such that a remainder of the anti-explosion device is protected from manual damage.

5. A cooking appliance, comprising:

a controller; and the cooking appliance muffle of claim 1.

6. A method for operating the cooking appliance of claim 5, wherein the anti-explosion device is automatically controlled by the controller such that the formation of the explosive gas mixture is prevented in any operating state of the cooking appliance muffle.

7. The method of claim 6, wherein the cooking appliance comprises a pyrolysis cooking appliance, and wherein the anti-explosion device is activated as a function of a presence of a pyrolysis operation of the cooking appliance.

8. The method of claim 7, wherein an ignition source of the anti-explosion device is automatically switched on as a function of a presence of a pyrolysis operation of the cooking appliance and is automatically switched off during operation of the cooking appliance outside the pyrolysis operation.

9. The cooking appliance muffle of claim 1, wherein the temperature of the ignition source is greater than or equal to 1000° C.

10. The cooking appliance muffle of claim 4, wherein a function of the anti-explosion device is fulfillable substantially equivalently compared to an anti-explosion device without the enclosure.

11. The cooking appliance muffle of claim 10, wherein the remainder of the anti-explosion device comprises an ignition source.

12. The method of claim 6, wherein the anti-explosion device is configured such that a proportion of a combustible component in the cooking chamber remains below a predetermined limit value for the combustible component in any operating state of the cooking appliance muffle.

13. The method of claim 8, wherein the ignition source, in a switched-on state of the ignition source after a warm-up time, permanently has a temperature equal to or greater than an ignition temperature of a theoretically possible explosive gas mixture.

14. A cooking appliance muffle for a cooking appliance, comprising:

a cooking chamber with a cooking chamber opening tightly closeable by a door of the cooking appliance, at least one cooking chamber wall bounding the cooking chamber, wherein the cooking appliance muffle is configured to be explosion-proof, wherein the cooking appliance muffle has, on a side of one of the at least one cooking chamber wall facing the cooking chamber, an anti-explosion device configured such that a formation of an explosive gas mixture is prevented in any operating state of the cooking appliance muffle, wherein the anti-explosion device comprises an enclosure, and wherein the enclosure surrounds a remainder of the anti-explosion device such that a remainder of the anti-explosion device is protected from manual damage.

15. The cooking appliance muffle of claim 14, wherein a function of the anti-explosion device is fulfillable substantially equivalently compared to an anti-explosion device without the enclosure.

16. The cooking appliance muffle of claim 15, wherein the remainder of the anti-explosion device comprises an ignition source.

17. A method for operating a cooking appliance that includes cooking appliance muffle with a cooking chamber with a cooking chamber opening tightly closeable by a door of the cooking appliance, at least one cooking chamber wall bounding the cooking chamber, the cooking appliance muffle being configured to be explosion-proof, the cooking appliance muffle having, on a side of one of the at least one cooking chamber wall facing the cooking chamber, an anti-explosion device configured such that a formation of an explosive gas mixture is prevented in any operating state of the cooking appliance muffle, and a controller, the method comprising:

automatically controlling the anti-explosion device by the controller such that the formation of the explosive gas mixture is prevented in any operating state of the cooking appliance muffle, wherein the cooking appliance comprises a pyrolysis cooking appliance, and wherein the anti-explosion device is activated as a function of a presence of a pyrolysis operation of the cooking appliance.

18. The method of claim 17, wherein an ignition source of the anti-explosion device is automatically switched on as a function of a presence of a pyrolysis operation of the cooking appliance and is automatically switched off during operation of the cooking appliance outside the pyrolysis operation.

19. The method of claim 18, wherein the ignition source, in a switched-on state of the ignition source after a warm-up time, permanently has a temperature equal to or greater than an ignition temperature of a theoretically possible explosive gas mixture.

* * * * *